US007959451B2

(12) United States Patent
Tonosaki

(10) Patent No.: US 7,959,451 B2
(45) Date of Patent: Jun. 14, 2011

(54) LEVER-TYPE CONNECTOR

(75) Inventor: Takashi Tonosaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/511,495

(22) Filed: Jul. 29, 2009

(65) Prior Publication Data

US 2010/0048053 A1 Feb. 25, 2010

(30) Foreign Application Priority Data

Aug. 19, 2008 (JP) ..... 2008-211186

(51) Int. Cl.
*H01R 13/62* (2006.01)

(52) U.S. Cl. ..... 439/157; 439/374

(58) Field of Classification Search ..... 439/299, 439/157, 372, 374
See application file for complete search history.

(56) References Cited

U.S. PATENT DOCUMENTS 5,269,696 A * 12/1993 Okada et al. ..... 439/140
7,329,133 B2 * 2/2008 Ishikawa et al. ..... 439/157
7,670,157 B2 * 3/2010 Miyamoto ..... 439/157

FOREIGN PATENT DOCUMENTS

JP 2008-027787 2/2008

* cited by examiner

*Primary Examiner* — T C Patel
*Assistant Examiner* — Travis Chambers
(74) *Attorney, Agent, or Firm* — Gerald E. Hespos; Michael J. Porco

(57) ABSTRACT

A connector is provided with a first housing (10) including a lever 30 rotatably mounted about supporting shaft bearings (34), and a second housing 60 including cam followers (63) engageable with cam grooves 41 of the lever 30 and to be connected with the first housing (10) by a cam action displayed between the cam grooves (41) and the cam followers (63) as the lever (30) is rotated. The second housing (60) includes posture correcting pins (66) at the opposite sides of the cam followers (63). The lever (30) is formed with posture correcting grooves (45) engageable with the posture correcting pins (66) in a rotating process thereof and extending along arcs centered on the supporting shaft bearings (34).

19 Claims, 12 Drawing Sheets

LEVER-TYPE CONNECTOR

BACKGROUND OF THE INVENTION

1. Field of the Invention

The invention relates to a lever-type connector.

2. Description of the Related Art

Japanese Unexamined Patent Publication No. 2008-27787 discloses a connector with male and female housings that are connectable with each other. A wire cover is mounted on a main body of the female housing and a lever is mounted rotatably in the wire cover. A cam groove is formed in the lever and a cam follower is provided on the male housing. A cam action is displayed between the cam groove and the cam follower as the lever is rotated so that the two housings are connected with a small connecting force. The lever is formed with an engaging groove in addition to the cam groove and the housing main body is provided with an engaging projection. The engaging projection slides in the engaging groove in the process of rotating the lever to prevent a displacement of the relative position of the wire cover with respect to the housing main body.

A lever operating force does not act evenly on the opposite widthwise sides of the female housing in the process of connecting the two housings. Thus, the housings may be inclined in a width direction as the connection proceeds. More particularly, the housings are likely to incline in the case of a multipolar connector that is long and narrow in a width direction. Such an inclination increases of a lever operating force and may result in insufficient contact margins of terminal fittings in the housings.

The invention was developed in view of the above situation and an object thereof is to prevent two housings from being inclined during a connecting operation.

SUMMARY OF THE INVENTION

The invention relates to a lever-type connector with a first housing and a lever mounted on the first housing for rotation about an axis of rotation. The connector also has a second housing with at least one engageable portion that is engageable with at least one engaging portion on the lever. The second connector can be connected with the first housing with a small connecting force due to a force multiplying action displayed between the engaging portion and the engageable portion as the lever is rotated. The second housing includes at least one posture correcting pin, and the lever is formed with at least one posture correcting groove that is engageable with the posture correcting pin in a rotating process thereof. The posture correcting groove extends along an arc substantially centered on the axis of rotation.

The posture correcting pin slides in the posture correcting groove as the lever is rotated for correcting the postures of the housings as the housings are being connected. Thus, the housings cannot incline during the connecting operation is prevented. Hence, a lever operating force is reduced and proper contact margins are ensured for terminal fittings in the housings.

A plurality of posture correcting pins preferably are formed on a surface of the second housing where the engageable portion is provided, and a plurality of posture correcting grooves preferably are formed in a surface of the lever where the engaging portion is provided. Thus, inclination of the two housings is prevented more reliably.

The respective posture correcting pins preferably are inserted into the corresponding posture correcting grooves substantially simultaneously in the process of connecting the two housings. Thus, a connection balance is better as compared with the case where the posture correcting pins are inserted with time lag.

The respective posture correcting pins preferably are paired at substantially opposite sides of the engageable portion while being substantially equidistant from the engageable portion. Thus, the connection balance is good and the inclination of the two housings is prevented even more reliably.

The engaging portion preferably is a cam groove, and the lever includes a crossing section where the cam groove and the posture correcting groove cross. Thus, space efficiency is better as compared with the case where the cam groove and the posture correcting groove do not cross.

The posture correcting pin may enter the cam groove, for example, by getting caught by one corner of the crossing section in the process of rotating the lever. Accordingly, the posture correcting groove preferably is deeper than the cam groove and the leading end of the posture correcting pin preferably is deeper than the bottom surface of the cam groove in the crossing section. Therefore, there is no likelihood that the posture correcting pin enters the cam groove and the reliability of a posture correcting function is ensured.

A lock preferably is provided on the lever and engages the first housing to prevent the lever from rotating beyond a connection position.

At least one detector preferably is mounted in the lever and can move only when the lever reaches connection position. A guide groove is formed between the axis of rotation and an operable portion of the lever for movably receiving the detector.

Centers of the posture correcting pin and the engageable portion are located substantially at the same positions in forward and backward directions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the subject invention includes first and second housings 10, 60 that are connectable with one another, as shown in FIGS. 1 through 9. A lever 30 is mounted rotatably on the first housing 10 and engages parts of the second housing to move the housings 10, 60 toward or away from one another. In the following description, connection ends of the two housings 10, 60 are referred to as front ends concerning forward and backward directions.

Figure 1:
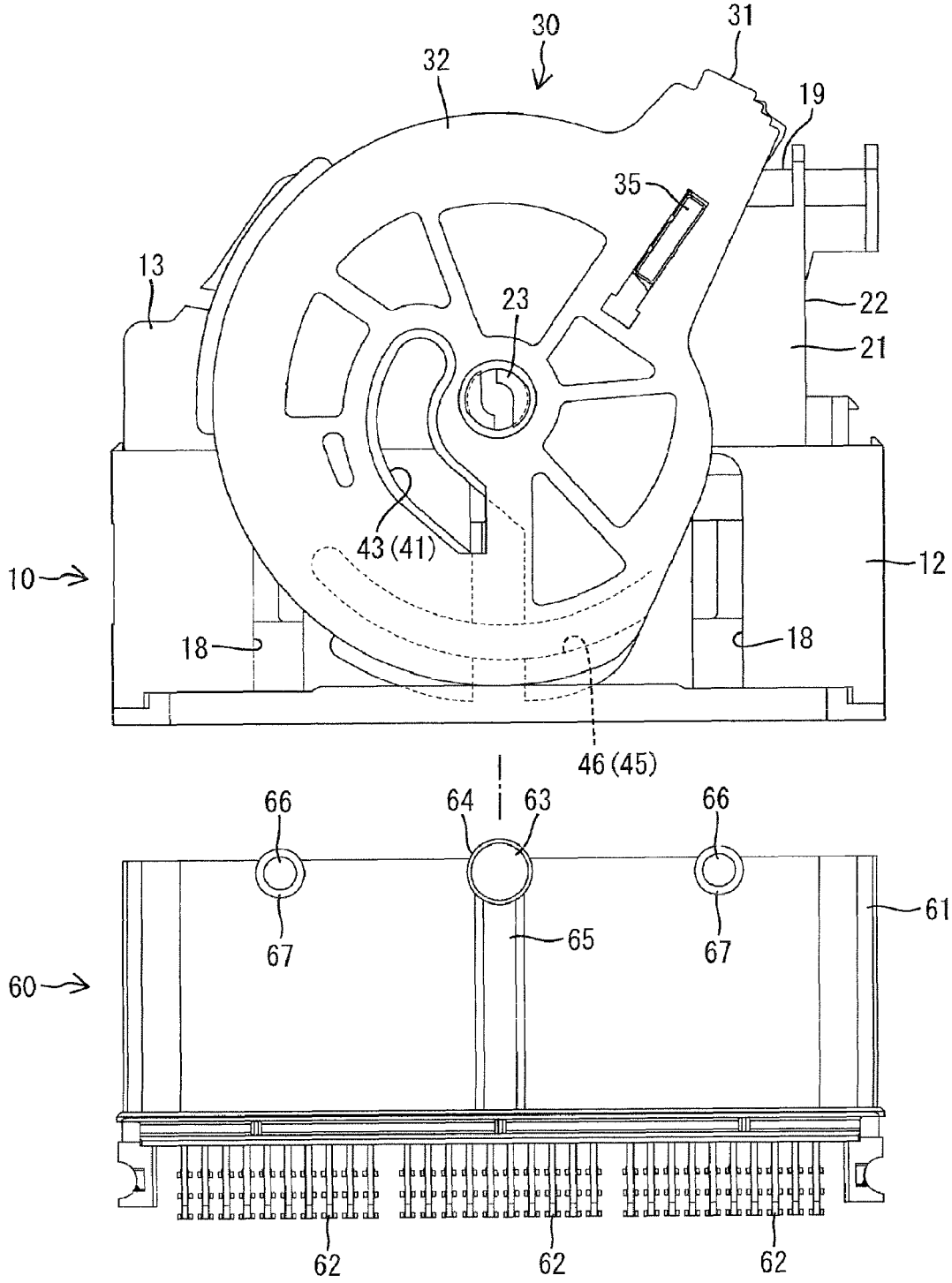
FIG. 1 is a plan view showing a state where a connector according to one embodiment of the invention is connected.

The second housing 60 is made e.g. of synthetic resin and includes a tubular receptacle 61 with an open front. The second housing is long and narrow in a width direction, as shown in FIG. 1. Leading end portions of male terminal fittings 62 project in the receptacle 61. The male terminal fittings 62 are pins or tabs that are drawn out backward from the rear surface of the back wall of the receptacle 61, and are bent at substantially right angles. Rear ends of the male terminal fittings 62 are connected (preferably soldered) to conductive paths of an unillustrated printed circuit board.

Upper and lower cam followers 63 project at substantially widthwise centers of the front ends of the outer surfaces of the upper and lower walls of the receptacle 61. Each cam follower 63 is cylindrical and a flange 64 projects outward at the leading end of the cam follower 63. A rib 65 extends substantially in forward and backward directions in a widthwise center position of the outer surface of the each of the upper and lower walls of the receptacle 61. Each rib 65 has a substantially flat end surface. The front ends of the ribs 65 project forward from the front-end opening edge of the receptacle 61, and the cam followers 63 project on end surfaces of the front ends of the ribs 65. Parts of the outer peripheries of the cam followers 63 are positioned to project forward from the front-end opening edge of the receptacle 61.

Upper and lower posture correcting pins 66 project at positions equidistant from the cam followers 63 on the front ends of the outer surfaces of the upper and lower walls of the receptacle 61. The posture correcting pins 66 are cylindrical and have smaller diameters than the cam followers 63. Projecting ends of the posture correcting pins 66 are more outward than the projecting ends of the cam followers 63. Cylindrical stages 67 are provided in widthwise intermediate parts of the outer surfaces of the upper and lower walls of the receptacle 61. The front ends of the stages 67 project forward from the front-end opening edge of the receptacle 61, and the posture correcting pins 66 project on end surfaces of these front ends. The outer peripheral edges of the posture correcting pins 66 are at substantially the same positions as the front-end opening edge of the receptacle 61 in forward and backward directions, and the centers of the posture correcting pins 66 and those of the cam followers 63 are at substantially the same positions in forward and backward directions.

Figure 9:
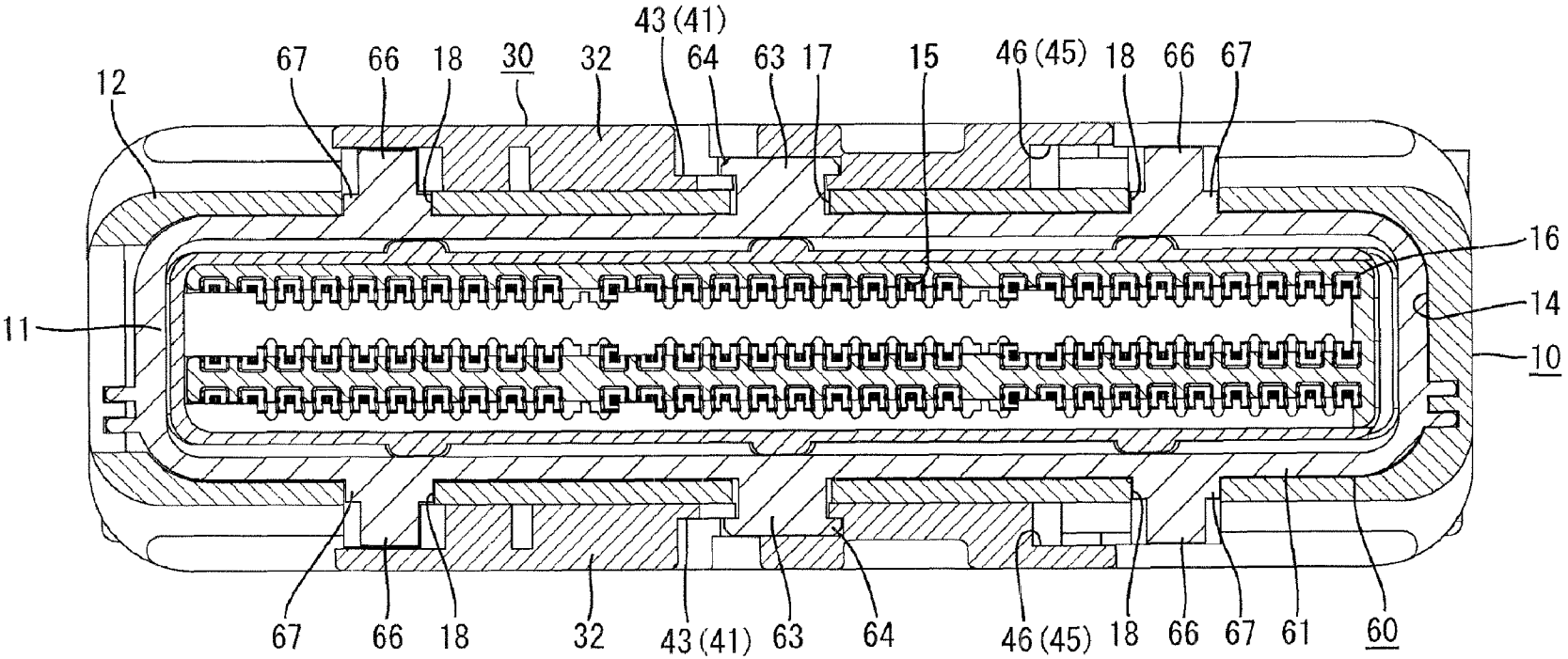
FIG. 9 is a section along X-X of FIG. 3.
Figure 10:
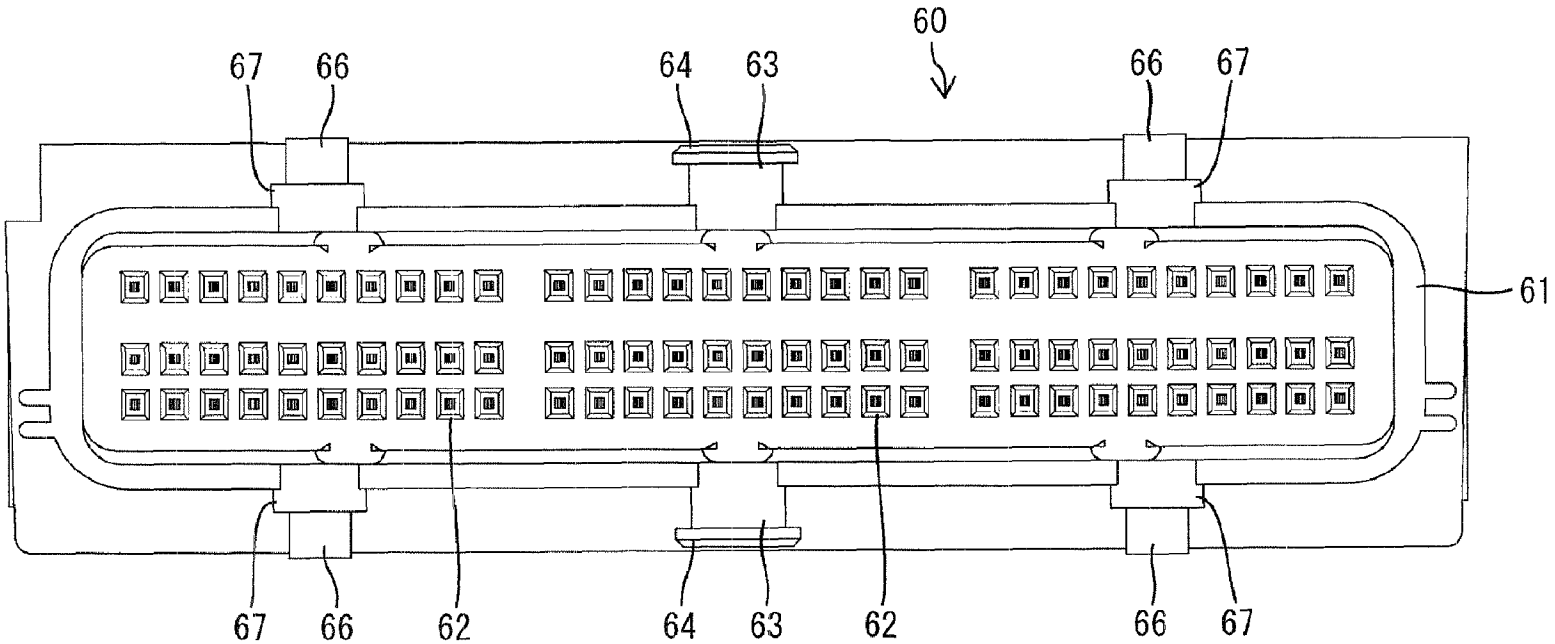
FIG. 10 is a front view of a second housing.

The first housing 10 is made e.g. of synthetic resin and has a block-shaped housing main body 11 that is long and narrow in the width direction. A fitting tube 12 surrounds the housing main body 11 and a wire cover 13 is mounted on a rear part of the housing main body 11, as shown in FIGS. 1 and 9. The lever 13 is mounted rotatably on the housing main body 11 and at least partly in the wire cover 13. A mount space is defined between the housing main body 11 and the fitting tube 12 for receiving the mating receptacle 61.

Cavities 15 are arranged in a plurality of columns in the width direction and in a plurality of levels in a height direction in the housing main body 11. The cavities 15 penetrate the housing main body 11 in forward and backward directions, and female terminal fittings 16 are insertable into the respective cavities 15 from behind. The female terminal fittings 16 are connected with ends of unillustrated wires, and the connected wires are drawn out from the rear surface of the housing main body 11.

Figure 2:
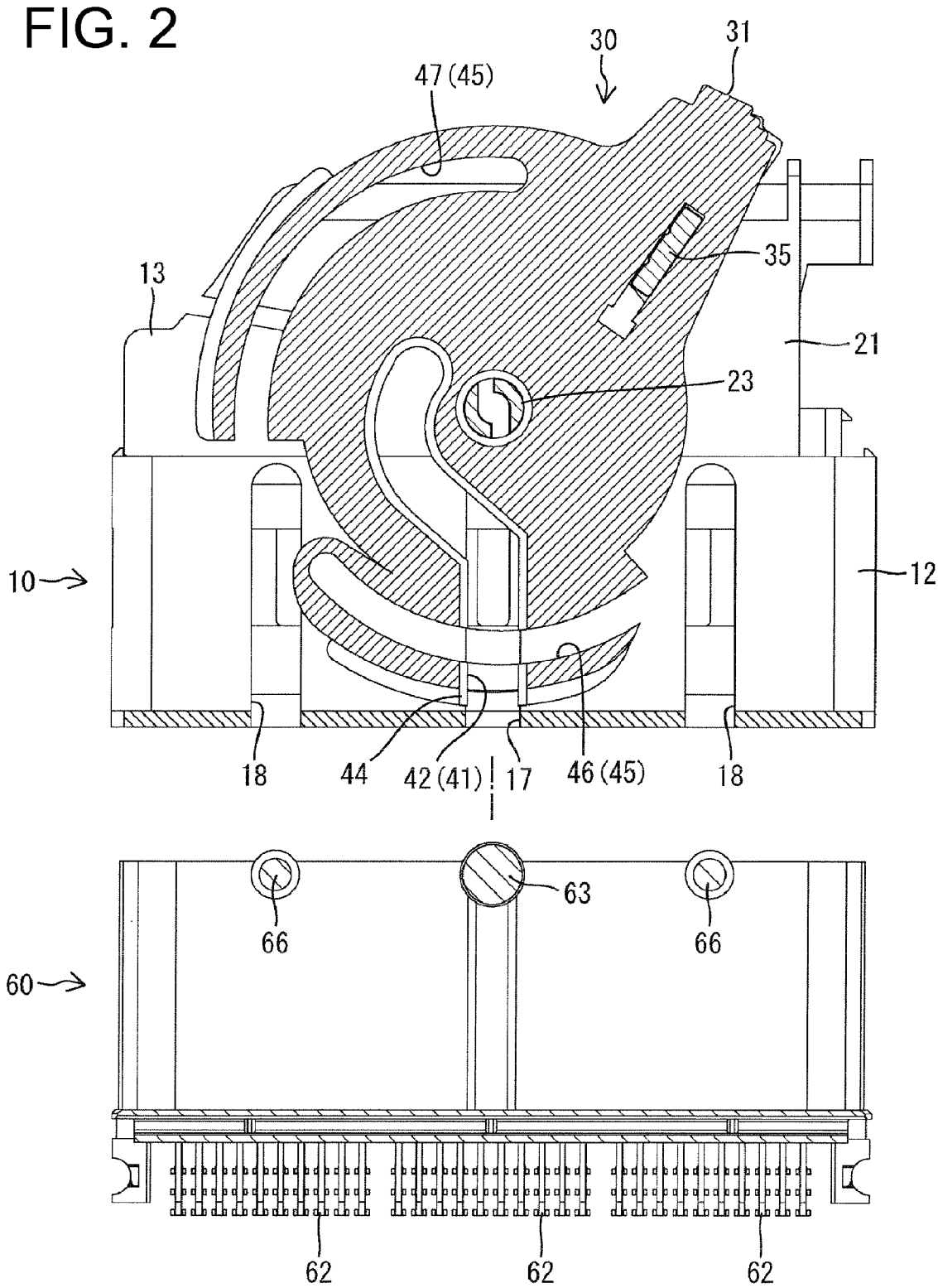
FIG. 2 is a plan view showing an essential part of the state of FIG. 1 in section.

The fitting tube 12 is formed with first second escaping grooves 17 and 18. The first escaping grooves 17 receive the cam followers 63 in the process of connecting the two housings 10, 60. The second escaping grooves 18 are at laterally symmetrical positions on opposite sides of the first escaping grooves 17 and receive the posture correcting pins 66 in the process of connecting the two housings 10, 60. As shown in FIG. 2, the first and second escaping grooves 17, 18 extend substantially straight in forward and backward directions and open at the front-end opening edge of the fitting tube 12.

The wire cover 13 is substantially cap-shaped and includes a back plate 19 facing the rear surface of the housing main body 11. Covering plates 21 project from opposite sides of the back plate 19 and are long and narrow in the width direction. One widthwise end of the wire cover 13 is open to define a wire outlet 22. The wires drawn out from the rear surface of the housing main body 11 are bent while extending substantially along the inner surface of the back plate 19, and are drawn out through the wire outlet 22 to extend substantially orthogonal to a connecting direction of the two housings 10, 60. Supporting shafts 23 project on the outer surfaces of the covering plates 21 and rotatably support the lever 30. Each supporting shaft 23 is substantially cylindrical and is formed by two half pieces that can be deformed to have a smaller diameter.

Figure 11:
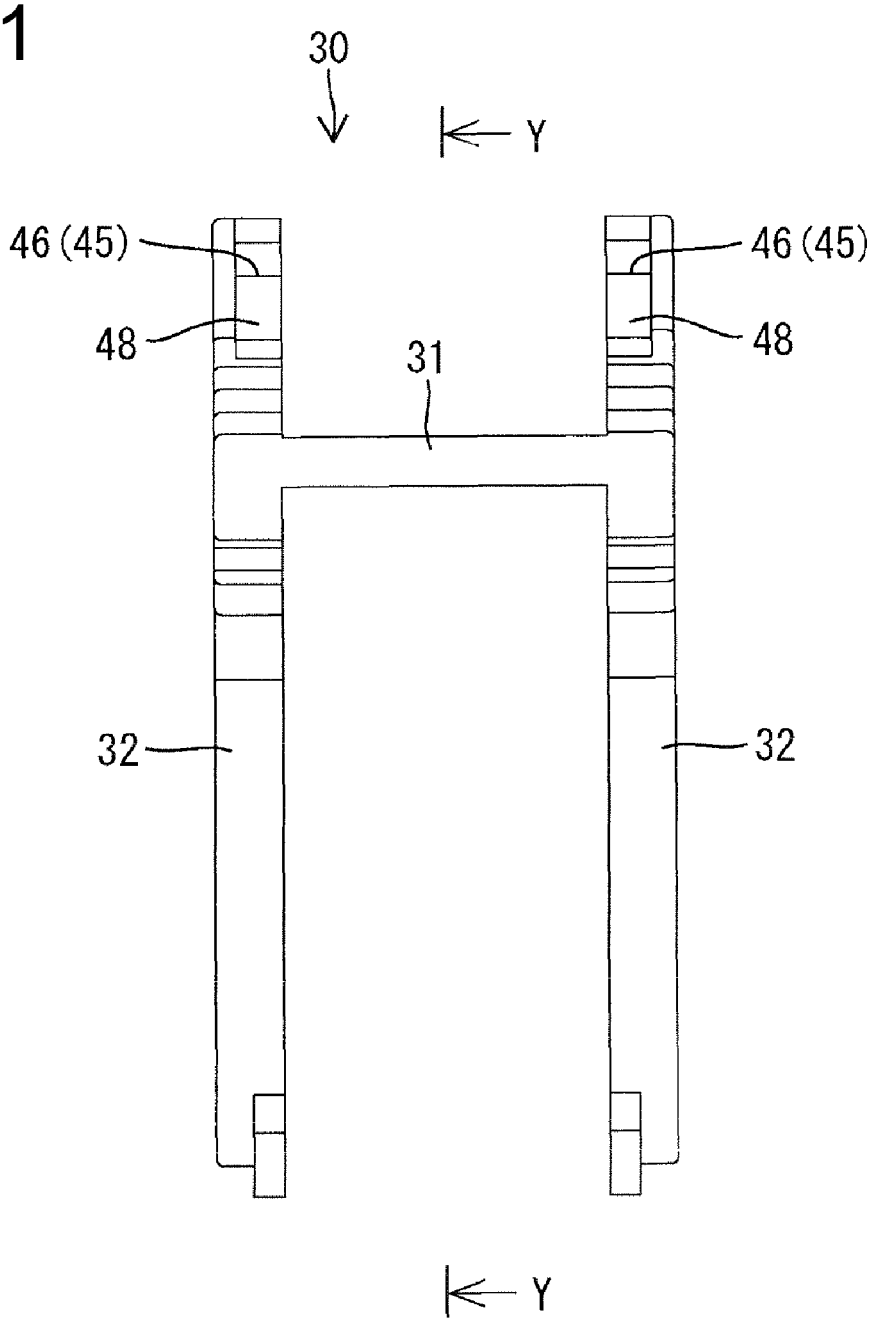
FIG. 11 is a rear view of the lever.
Figure 12:
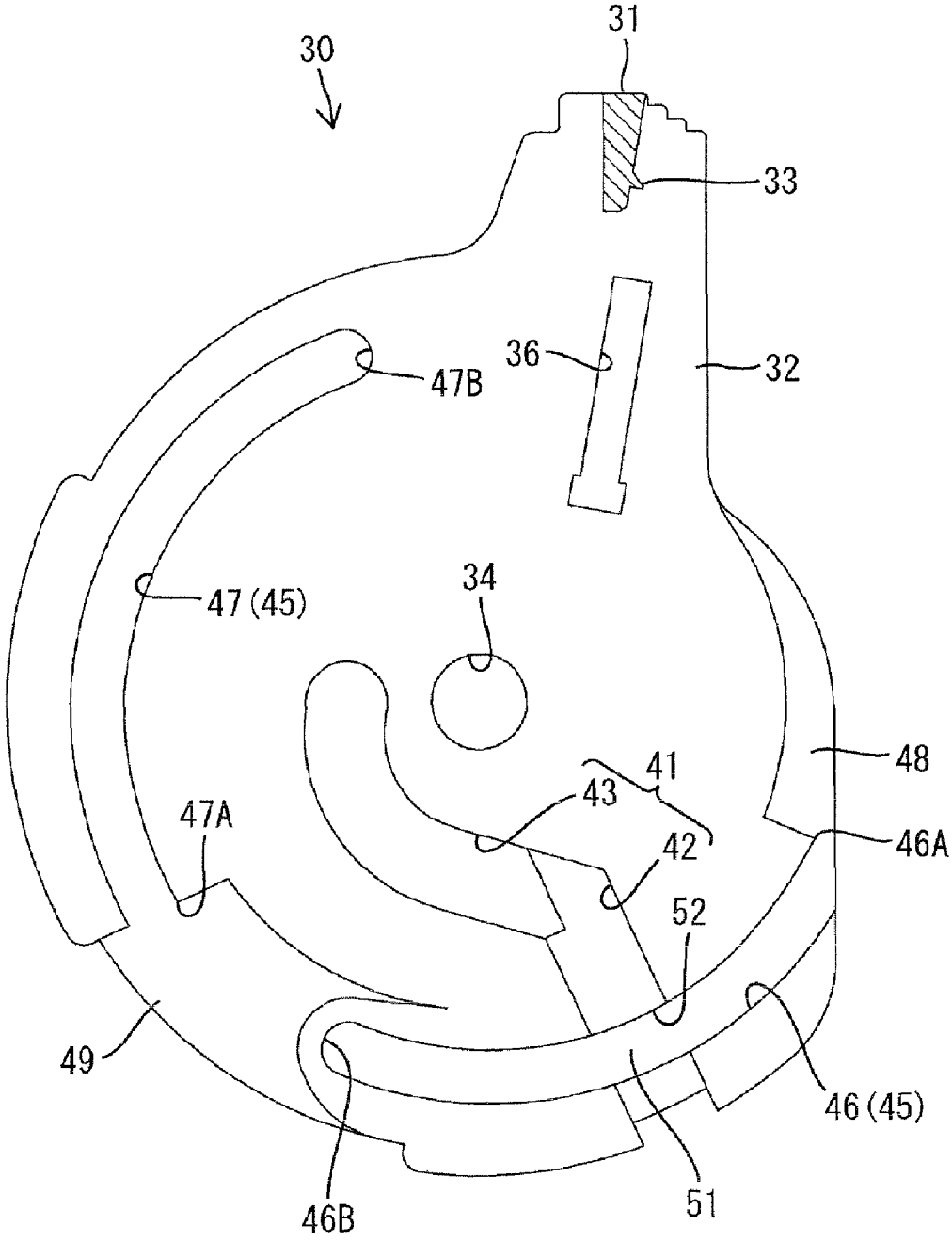
FIG. 12 is a section along Y-Y of FIG. 11.

The lever 30 is made e.g. of synthetic resin and includes an operable portion 31 arranged behind the back plate 19 and two parallel arms 32 that project from opposite ends of the operable portion 31 to define a U-shape, as shown in FIG. 11. The operable portion 31 includes a lock 33, as shown in FIG. 12. The lock 33 resiliently engages the wire cover 13 to hold the lever 30 at the connection position and to prevent rotation. Each arm 32 is a substantially round plate, and a supporting shaft bearing 34 for engaging the supporting shaft 23 penetrates the center of the arm 32. The lever 30 is rotatable about the supporting shaft bearings 34 and the supporting shafts 23 between an initial position where the operable portion 31 is near the wire outlet 22 of the wire cover 13 and the connection position where the operable portion 31 is distant from the wire outlet 22. A substantially bar-shaped detector 35 is mounted in each arm 32 and is permitted to move only when the lever 30 reaches the connection position. A guide groove 36 is formed between the supporting shaft bearing 34 and the operable portion 31 for movably receiving the detecting member 35.

Each arm 32 also is formed with a cam groove 41 that is engageable with the mating cam follower 63. The cam groove 42 has a lead-in groove 42 and an action groove 43. The lead-in groove 42 extends substantially straight in forward and backward directions when the lever 30 is at the initial position and opens at the outer peripheral edge of the arm 32. The action groove 43 extends from the rear end of the lead-in groove 42 in a curve around the supporting shaft bearing 34. The lead-in groove 42 is formed to have about ⅓ or more of the entire length of the cam groove 41. As shown in FIG. 2, guide edges 44 are formed in the side surfaces of the cam groove 41 for slidably receiving the flange 64. The lead-in groove 42 is a bottomed groove having an outer side at least partly covered by the outer wall of the arm 32. The action groove 43 penetrates the arm 32 in a thickness direction.

First and second posture correcting grooves 46 and 47 are formed in the inner surfaces of the arms 32 for receiving the respective posture correcting pins 66 and are illustrated respectively at the right and left sides of FIG. 12. The first and second posture correcting grooves 46 and 47 are identified collectively by the reference numeral 45. Each posture correcting groove 45 is a bottomed groove having an outer side covered by the outer wall of the arm 32 and has an arcuate shape centered on the supporting shaft bearing 34. The posture correcting grooves 45 are narrower than the cam grooves 41. The first posture correcting groove 46 includes a first starting end 46A that is open at a position near the operable portion 31 and a first terminal end 46B closed at a position distant from the operable portion 31. The first posture correcting groove 46 intersects the lead-in groove 42 at an intermediate position between the first starting end 46A and the first terminal end 46B, specifically in a lengthwise middle part. On the other hand, the second posture correcting groove 47 includes a second starting end 47A that is open at a position distant from the operable portion 31 and a second terminal end 47B closed at a position near the operable portion 31. The second posture correcting groove 47 does not communicate with the cam groove 41. A first recess 48 is formed in the inner surface of the arm 32 between the outer peripheral edge of the arm 32 and the first starting end 46A. The first recess 48 has a bottom surface substantially flush and continuous with the first posture correcting groove 46 and crosses at substantially right angles to the first starting end 46A. Further, a first recess 49 is formed between the first starting end 46A and the second starting end 47A. The recess 49 has a bottom surface substantially flush and continuous with the second posture correcting groove 47 and crosses at substantially right angles to the second starting end 47A A crossing section 51 is defined where the first posture correcting groove 46 and the lead-in groove 42 cross. The first posture correcting groove 46 is deeper than the lead-in groove 42 and a step 52 sunken toward the first posture correcting groove 46 is formed between the lead-in groove 42 and the first posture correcting groove 46. The posture correcting pins 66 slide substantially on the groove surfaces of the posture correcting grooves 45 during the rotation of the lever 30 while being fit closely in the posture correcting grooves 45. The cam pins slide substantially on the groove surfaces of the cam grooves 41 while being fit closely in the cam grooves 41.

Figure 3:
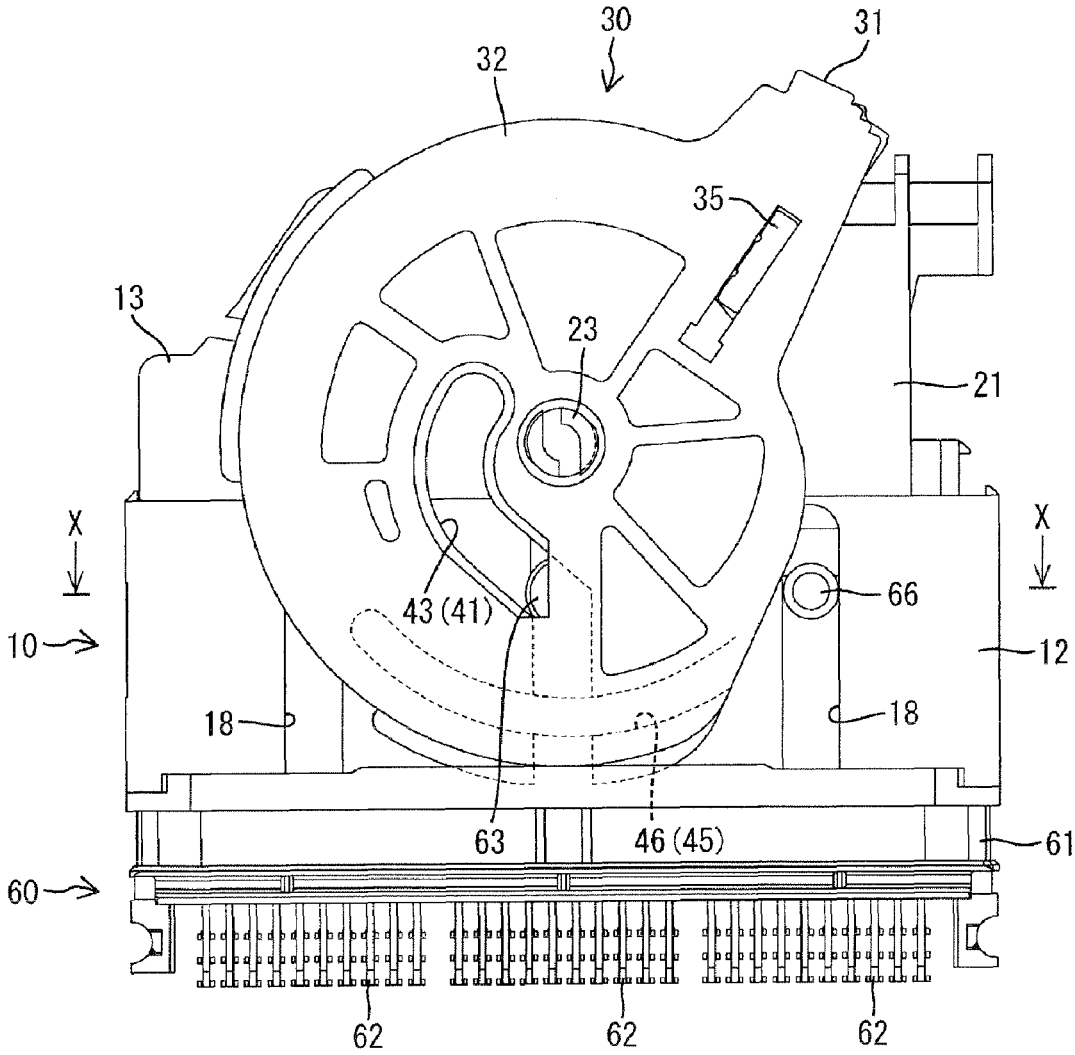
FIG. 3 is a plan view showing a state immediately before a lever is rotated after a connector connecting operation is started.
Figure 4:
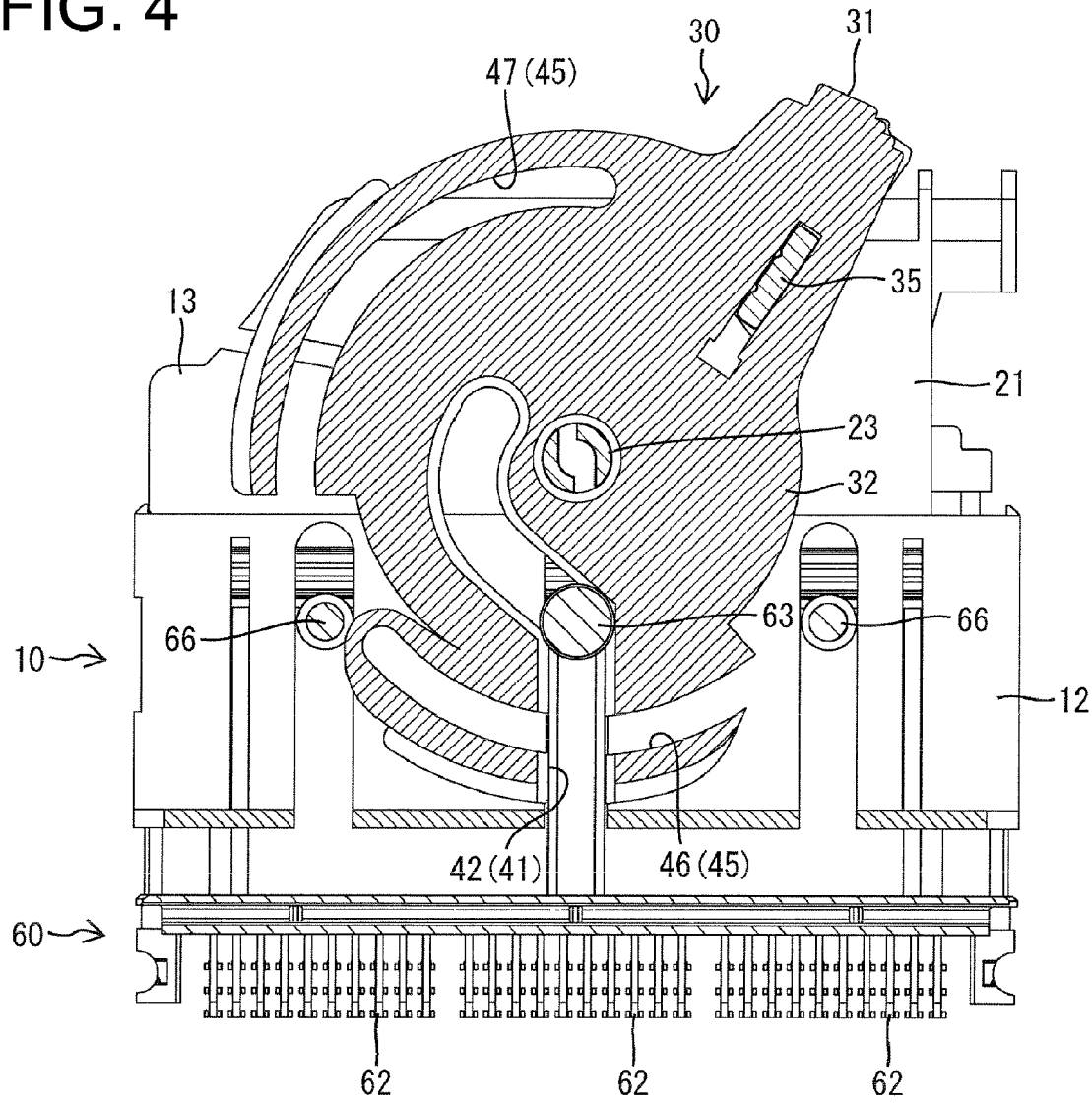
FIG. 4 is a plan view showing an essential part of the state of FIG. 3 in section.
Figure 5:
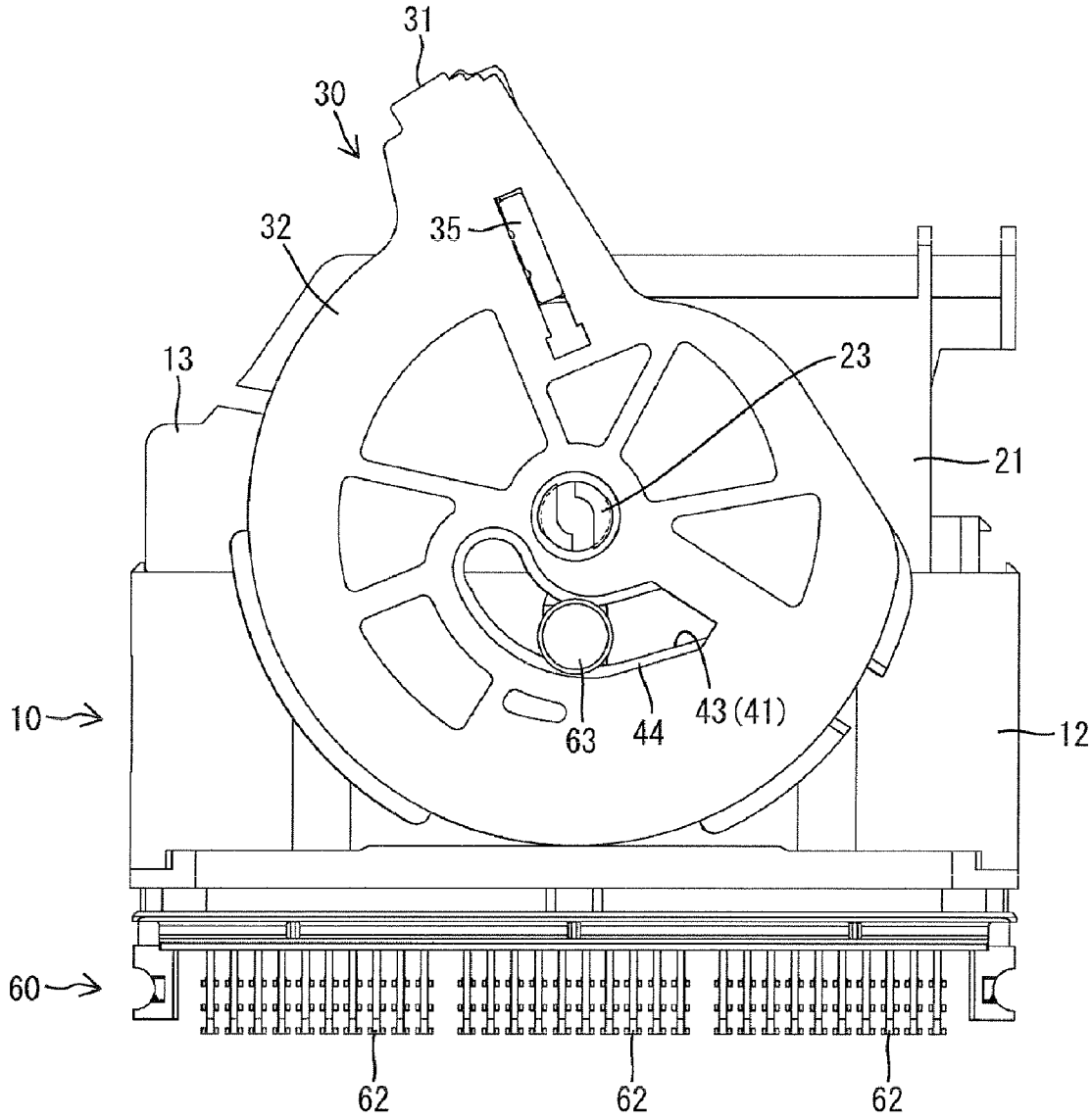
FIG. 5 is a plan view showing an intermediate state during the rotation of the lever.
Figure 6:
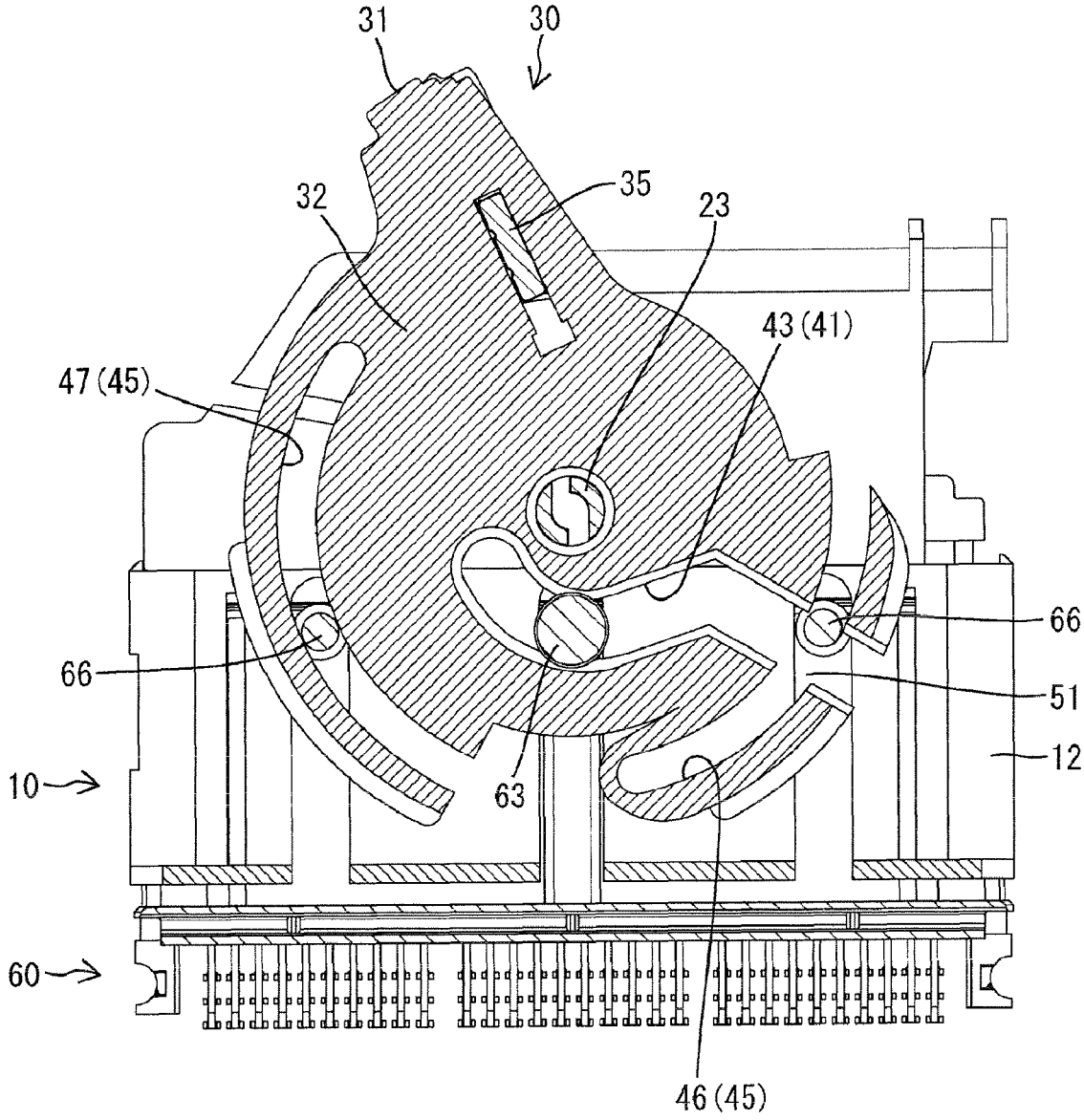
FIG. 6 is a plan view showing an essential part of the state of FIG. 5 in section.

The lever 30 is held at the initial position with respect to the first housing 10 so that the entrances of the lead-in grooves 42 open forward. The connecting operation of the two housings 10, 60 then is started with the two housings 10, 60 arranged opposite to each other, as shown in FIGS. 1 and 2. In the connecting process, the receptacle 61 of the second housing 60 is inserted into the mount space 14 of the first housing 10, the cam followers 63 are inserted into the first escaping grooves 17 and the lead-in grooves 42, and the posture correcting pins 66 are inserted into the second escaping grooves 18. The connecting operation proceeds so that the cam followers 63 reach the terminal ends of the lead-in grooves 42 at the start ends of the action grooves 43 and the posture correcting pins 66 are arranged at positions to face the corresponding first and second recesses 48 and 49, as shown in FIGS. 3 and 4. The operable portion 31 then is manipulated to rotate the lever 30 about the supporting shafts 23 and toward the connection position. The cam followers 63 then slide on the groove surfaces of the action grooves 43 to display the cam action for connecting the housings 10, 60 with a small connecting force.

Figure 7:
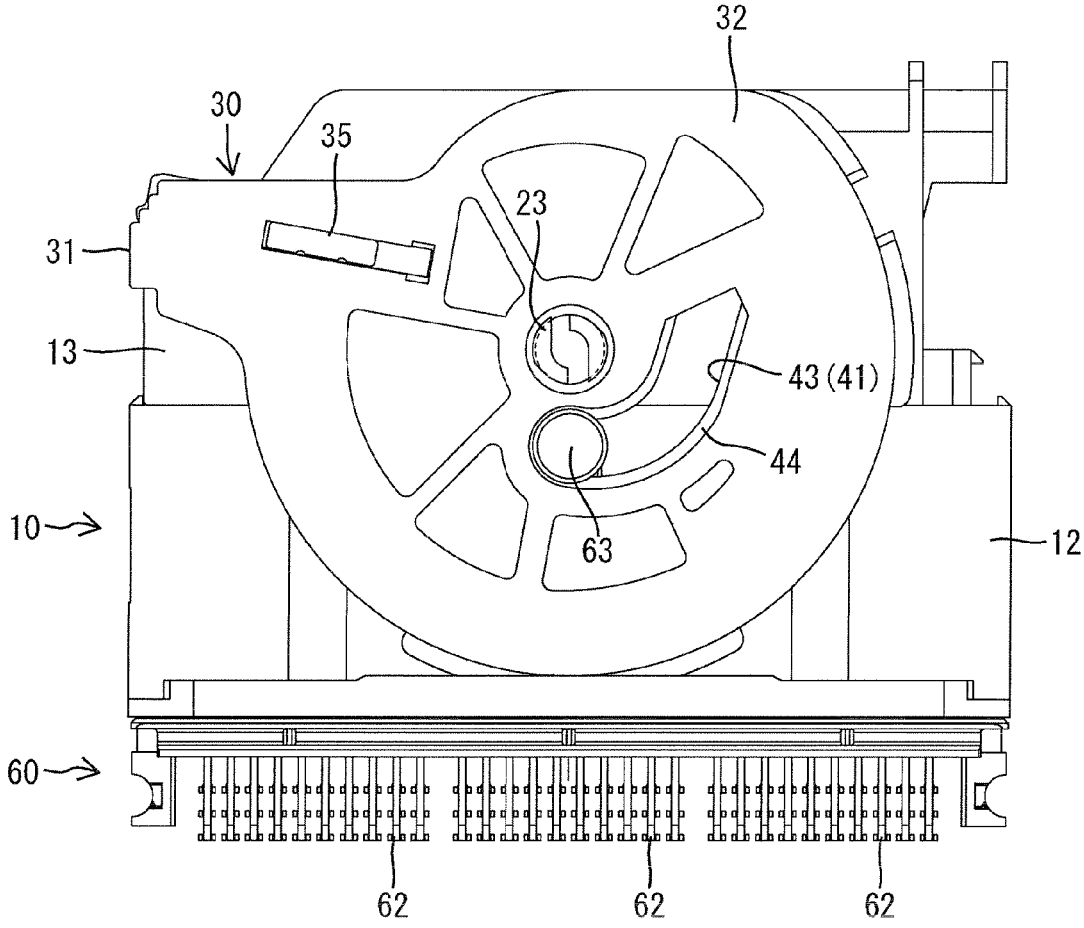
FIG. 7 is a plan view showing a state reached by rotating the lever to a connection position.
Figure 8:
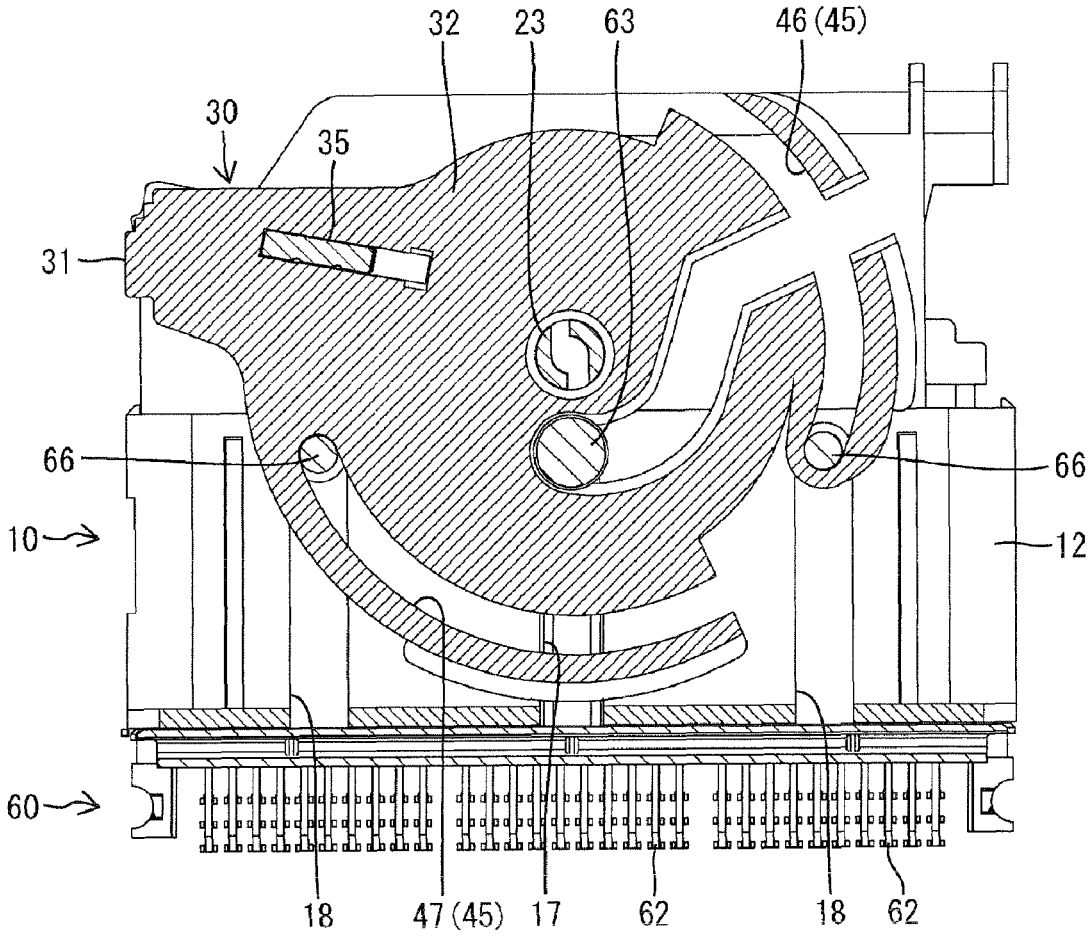
FIG. 8 is a plan view showing an essential part of the state of FIG. 7 in section.

The posture correcting pins 66 are inserted into the corresponding first and second recesses 48, 49 upon starting the rotation of the lever 30 and then simultaneously enter the corresponding posture correcting grooves 45. At this time, the posture correcting pins 66 are engaged into the posture correcting grooves 45 at substantially laterally symmetrical positions with respect to the supporting shafts 23 of the first housing 10. Thus, a rotation balance of the lever 30 is corrected properly. Further, the projecting ends of the posture correcting pins 66 are deeper than the lead-in grooves 42 and slide on the bottom surfaces of the posture correcting grooves 45. Thus, the posture correcting pins 66 do not get caught by corners of the crossing sections 51 at the positions shown in FIGS. 5 and 6, and do not do not enter the cam grooves 41. When the lever 30 reaches the connection position, as shown in FIGS. 7 and 8, the cam followers 63 reach the terminal ends of the action grooves 43, the posture correcting pins 66 reach the first and second terminal ends 46B, 47B of the posture correcting grooves 45 and the two housings 10, 60 are held properly connected. The terminal fittings 16, 62 start touching each other after a while following the engagement of the posture correcting pins 66 into the posture correcting grooves 45 and are connected to a proper depth as the two housings 10, 60 are connected properly.

As described above, the posture correcting pins 66 slide in the posture correcting grooves 45 as the lever 30 is rotated. Thus, the postures of the two housings 10, 60 being connected are corrected properly and the two housings 10, 60 cannot incline in the width direction. As a result, the force for operating the lever 30 is reduced and the terminal fittings 16, 62 are connected properly with substantially constant contact margins over the entire widths.

Further, two posture correcting pins 66 are provided on each of the upper and lower surfaces of the second housing 60 where the cam followers 63 are provided, and two posture correcting grooves 45 are formed in each arm 32 of the lever 30 formed with the cam groove 41. Thus, a posture correcting function is displayed at a plurality of positions and the inclination of the two housings 10, 60 is prevented more reliably.

The respective posture correcting pins 66 are inserted substantially simultaneously into the corresponding posture correcting grooves 45 in the process of connecting the two housings 10, 60. Thus, connection balance is better than in the case where the posture correcting pins 66 are inserted with a time lag.

The respective posture correcting pins 66 are paired at the opposite sides of the cam followers 63 and are substantially equidistant from the cam followers 63. Thus, the connection balance is good and the inclination of the two housings 10, 60 is prevented even more reliably. Further, the lever 30 is formed with the crossing sections 51 where the lead-in grooves 42 and the first posture correcting grooves 46 cross. Thus, space efficiency is better and a higher degree of freedom in design is obtained as compared with the case where the cam grooves 41 and the posture correcting grooves 45 do not intersect. The posture correcting pins 66 should not enter the lead-in grooves 42 by getting caught by corners of the crossing sections 51 in the process of rotating the lever 30. However, the first posture correcting grooves 46 are deeper than the lead-in grooves 42 in the crossing sections 51 and the leading ends of the posture correcting pins 66 are deeper than the bottom surfaces of the lead-in grooves 42. Therefore, there is no likelihood that the posture correcting pins 66 enter the lead-in grooves 42 and the reliability of the posture correcting function is ensured. The first posture correcting grooves 46 and the lead-in grooves 42 both are bottomed grooves. Thus, the crossing sections 51 do not significantly reduce the strength of the lever 30.

The invention is not limited to the above described and illustrated embodiment. For example, the following embodiments are also included in the technical scope of the present invention.

Only one posture correcting groove may be formed in at least one of the arm portions, preferably in each arm portion, and only one posture correcting pin may be provided on at least one (preferably in each) of the upper and lower surfaces of the second housing.

Three or more posture correcting grooves may be formed in each arm portion and three or more posture correcting pin may be provided on each of the upper and lower surfaces of the second housing.

The posture correcting grooves and the cam grooves may not communicate.

The posture correcting grooves may penetrate the arm portions in the thickness direction.

The lever may be rotatably mounted on the housing main body.

The lever may be a leverage lever. In this case, the lever is formed with hook-shaped catching portions (engaging portions) instead of the cam grooves, and the second housing may be provided with catch receiving portions (engageable portions) to be caught by the catching portions instead of the cam followers.

What is claimed is:

1. A lever-type connector, comprising:

a first housing including a lever rotatably mounted about an axis of rotation; and a second housing including first and second opposed walls each having an outer surface and at least one engageable portion disposed on the outer surface of the first wall and engageable with at least one engaging portion provided at the lever and to be connected with the first housing with a small connecting force by a force multiplying action displayed between the engaging portion and the engageable portion as the lever is rotated, wherein:

a plurality of posture correcting pins formed on the outer surface of the first wall of the second housing and at opposite sides of the engageable portion, and the lever is formed with a plurality of posture correcting grooves engageable with the posture correcting pins in a rotating process thereof and extending along an arc substantially centered on the axis of rotation.

2. The lever-type connector of claim 1, the lever has a lock that resiliently engages the first housing at the connection position to prevent further rotation.

3. The lever-type connector of claim 1, wherein the respective posture correcting pins are disposed to be insertable substantially simultaneously into the corresponding posture correcting grooves in the process of connecting the two housings.

4. The lever-type connector of claim 3, wherein the respective posture correcting pins are substantially equidistant from the engageable portion.

5. The lever-type connector of claim 1, wherein:

the engaging portion is a cam groove, and the lever includes a crossing section where the cam groove and one of the posture correcting grooves cross.

6. The lever-type connector of claim 5, wherein a depth of the one posture correcting groove measured parallel to the axis of rotation exceeds a depth of the cam groove measured parallel to the axis of rotation and a projecting distance of the posture correcting pin exceeds the depth of the cam groove in the crossing section.

7. A lever-type connector, comprising:

a first housing including a lever rotatably mounted about an axis of rotation; and a second housing including at least one engageable portion engageable with at least one engaging portion provided at the lever and to be connected with the first housing with a small connecting force by force multiplying action displayed between the engaging portion and the engageable portion as the lever is rotated, wherein:

the second housing includes at least one posture correcting pin, the lever is formed with at least one posture correcting groove engageable with the posture correcting pin in a rotating process thereof and extending along an arc substantially centered on the axis of rotation, and at least one detector is mounted in the lever and is permitted to move only when the lever reaches a connection position and a guide groove is formed between the axis of rotation and an operable portion of the lever for movably receiving the detector.

8. The lever-type connector of claim 7, the lever has a lock that resiliently engages the first housing at the connection position to prevent further rotation.

9. The lever-type connector of claim 7, wherein:

a plurality of posture correcting pins are formed on a surface of the second housing where the engageable portion is provided, and a plurality of posture correcting grooves are formed in a surface of the lever where the engaging portion is provided.

10. The lever-type connector of claim 9, wherein the respective posture correcting pins are insertable substantially simultaneously into the corresponding posture correcting grooves in the process of connecting the two housings.

11. The lever-type connector according to claim 10, wherein the respective posture correcting pins are paired at opposite sides of the engageable portion while being substantially equidistant from the engageable portion.

12. The lever-type connector of claim 7, wherein:

the engaging portion is a cam groove, and the lever includes a crossing section where the cam groove and the posture correcting groove cross.

13. The lever-type connector of claim 12, wherein a bottom surface of the posture correcting groove and the leading end of the posture correcting pin are deeper than a bottom surface of the cam groove in the crossing section.

14. A lever-type connector, comprising:

a first housing including a lever rotatably mounted about an axis of rotation; and a second housing having opposite front and rear ends spaced apart along forward and backward directions, the front end being configured for connection with the first housing, the second housing including at least one engageable portion engageable with at least one engaging portion provided at the lever and to be connected with the first housing with a small connecting force by force multiplying action displayed between the engaging portion and the engageable portion as the lever is rotated, wherein:

the second housing includes at least one posture correcting pin, the lever is formed with at least one posture correcting groove engageable with the posture correcting pin in a rotating process thereof and extending along an arc substantially centered on the axis of rotation, centers of the posture correcting pin and the engageable portion are located substantially at the same positions in the forward and backward directions, and the lever has a lock that resiliently engages the first housing at a connection position to prevent further rotation.

15. The lever-type connector of claim 14, wherein:

a plurality of posture correcting pins are formed on a surface of the second housing where the engageable portion is provided, and a plurality of posture correcting grooves are formed in a surface of the lever where the engaging portion is provided.

16. The lever-type connector of claim 15, wherein the respective posture correcting pins are insertable substantially simultaneously into the corresponding posture correcting grooves in the process of connecting the two housings.

17. The lever-type connector according to claim 16, wherein the respective posture correcting pins are paired at opposite sides of the engageable portion while being substantially equidistant from the engageable portion.

18. The lever-type connector of claim 14, wherein:

the engaging portion is a cam groove, and the lever includes a crossing section where the cam groove and the posture correcting groove cross.

19. The lever-type connector of claim 18, wherein a bottom surface of the posture correcting groove and the leading end of the posture correcting pin are deeper than a bottom surface of the cam groove in the crossing section.

* * * * *